US005179792A

United States Patent [19]

Brantingham

[11] Patent Number: 5,179,792

[45] Date of Patent: Jan. 19, 1993

[54] SHOE SOLE WITH RANDOMLY VARYING SUPPORT PATTERN

[76] Inventor: Charles R. Brantingham, 1541 Los Padres Rd., Nipomo, Calif. 93444

[21] Appl. No.: 682,092

[22] Filed: Apr. 5, 1991

[51] Int. Cl.[5] ..... A43B 13/20

[52] U.S. Cl. ..... 36/29; 251/4; 36/3 B; 36/71

[58] Field of Search ..... 36/28, 29, 3 B, 3 R, 36/93, 71, 88; 137/595; 251/4, 6

[56] References Cited

U.S. PATENT DOCUMENTS

| | | | |
|---|---|---|---|
| 1,506,975 | 9/1924 | Cooney | 36/28 X |
| 1,517,171 | 11/1924 | Rosenwasser | 36/29 |
| 3,434,715 | 3/1969 | Brantingham et al. | 227/57 |
| 3,608,215 | 9/1971 | Fukuoka | 36/29 |
| 4,071,963 | 2/1978 | Fukuoka | 36/3 B |
| 4,123,855 | 11/1978 | Thedford | 36/40 |
| 4,129,951 | 12/1978 | Petrosky | 36/29 |
| 4,183,156 | 1/1980 | Rudy | 36/44 |
| 4,217,705 | 8/1980 | Donzis | 36/29 |
| 4,219,945 | 9/1980 | Rudy | 36/29 |
| 4,229,990 | 10/1980 | Petrosky | 36/28 |
| 4,263,728 | 4/1981 | Frecentese | 36/129 |
| 4,319,412 | 3/1982 | Muller et al. | 36/29 |
| 4,340,626 | 7/1982 | Rudy | 428/35 |
| 4,358,902 | 11/1982 | Cole et al. | 36/28 |
| 4,414,760 | 11/1983 | Faiella | 36/28 |
| 4,446,634 | 5/1984 | Johnson et al. | 36/28 X |
| 4,457,339 | 7/1984 | Juan et al. | 251/6 X |
| 4,458,430 | 7/1984 | Peterson | 36/28 |
| 4,462,171 | 7/1984 | Whispell | 36/3 |
| 4,547,978 | 10/1985 | Radford | 36/3 |
| 4,617,745 | 10/1986 | Batra | 36/3 |
| 4,744,157 | 5/1988 | Dubner | 36/93 X |
| 4,763,426 | 8/1988 | Polus et al. | 36/29 |
| 4,777,739 | 10/1988 | Hiles | 36/43 |
| 4,878,622 | 11/1989 | Jamison et al. | 251/6 X |

FOREIGN PATENT DOCUMENTS

| | | | |
|---|---|---|---|
| 0062622 | 10/1982 | European Pat. Off. | 36/29 |
| 1024960 | 1/1953 | France | 36/3 R |
| 2614510 | 11/1988 | France | 36/29 |
| 2073006 | 10/1981 | United Kingdom | 36/29 |
| 8200571 | 3/1982 | World Int. Prop. O. | 36/29 |
| 8910074 | 11/1989 | World Int. Prop. O. | 36/29 |

*Primary Examiner*—Paul T. Sewell
*Assistant Examiner*—BethAnne C. Cicconi
*Attorney, Agent, or Firm*—Fulwider, Patton, Lee & Utecht

[57] ABSTRACT

A shoe sole or insole incorporates an inflatable cell structure therein. The cells are sized and positioned to alter the angular orientation of a wearer's foot relative to a supporting surface upon inflation. A variable position valve causes the cells to inflate and deflate in a random or pseudo-random sequence. Such a sole when worn while standing on or traversing a flat, even, and unvarying terrain enhances the wearer's comfort, reduces fatigue and promotes control of veinous blood pressure in the legs.

10 Claims, 4 Drawing Sheets

SHOE SOLE WITH RANDOMLY VARYING SUPPORT PATTERN

BACKGROUND OF THE INVENTION

1. Field of the Invention

The present invention relates to shoe sole construction, and more particularly, pertains to shoe soles or insoles that incorporate expandable or inflatable support cells.

2. Description of the Prior Art

Research has revealed that some foot complaints are caused by the reduced use of those leg and foot muscles that control compensatory action of the foot and ankle to variation in the plane or attitude of the surfaces encountered by the foot. These same muscles are additionally called upon to assist in pumping blood from the foot and leg back up to the heart. In fact, when a person stands perfectly still, and those muscles are not used, the venous pressure in the lower part of the legs can rise to the full hydrostatic value of about 110 to 130 cm of water in less than one minute. Under such circumstances, the pressure within the capillaries at the distal end of the lower extremities also increases greatly, and fluid flows into the tissue spaces. This, in addition to the capacitive enlargement of the veins of the legs, causes swelling and in as little as 15 minutes can diminish blood supply to the brain sufficiently to cause fainting. The pumping function is accomplished by the muscles with the cooperation of a multitude of one-way valves within veins located throughout the musculature of the leg and foot. Two to four such valves are typically found within each foot, while another 25 to 30 valves are normally disposed in veins within the extrinsic foot muscles in the leg below the knee. Contraction of such muscles proximate to a particular vein forces blood up past the next one-way valve which in turn prevents the blood's decent upon relaxation of those muscles. This comprises 70–80% of the mechanism by which blood is pumped from leg area back up to the heart.

Activity of these particular muscle groups therefore not only serves to alleviate some foot problems, but additionally controls veinous pressure to thereby enhance the body's overall blood circulation. The muscles are most readily exercised when successive steps taken while walking or successive stances assumed while standing cause each foot to assume a slightly different angular relation to the horizontal as compared with the previous position occupied thereby. This requisite angular variation is more readily achieved when the foot is caused to function on natural terrain, with its attendant irregularities and non-unformities, rather than on the flat, level, unyielding and unchanging surfaces typically encountered in an urban setting. The foot is after all well adapted to engage irregular surfaces due to the curved structure of the ball and heel while the city's concrete, asphalt and hardwood floors are more geared to accommodate wheeled traffic.

It has additionally been found that in order for the majority of these muscles to be best utilized, the variation in angular orientation of the foot should follow a random or pseudo-random sequence. Repeated short sequences are quickly learned and the body will tend to employ only a few favored muscles to compensate for variation in angular orientation when the successive orientations can be anticipated. Unpredicted or unexpected variation in orientation, as when the foot encounters natural or varied terrain causes all muscles to be used in a more properly balanced function.

The invention of U.S. Pat. No. 3,434,715, in which the inventor of the present invention is named as a coinventor, addresses this problem and describes a floor covering that provides the requisite variation in terrain for a person standing or walking thereon. The floor covering comprises a resilient support surface, which incorporates irregularly shaped and irregularly spaced areas of increased density. A person's foot supported thereby will assume slightly different angular orientations or attitudes depending on precisely where the foot encounters a particular area of increased density. Consequently walking there-across or standing thereon while shifting one's stance will result in the more balanced activity of the described muscle groups.

Shoe or orthotic design to date has not provided means to induce the proper activity of the described muscle groups. While various shoe sole systems have been disclosed that incorporate fluid-filled or inflatable cells, pumps and valving, traversal of flat and level terrain nonetheless results in predictable and unchanging placement of the foot with every step. The disclosed designs typically seek to cushion the loads a foot is subjected to while walking or running. Additionally, shoe sole structures are disclosed that provide for the ventilation of the shoe sole by pumping fluid through various cells to reduce temperatures. Some designs call for the circuiting of various fluids contained in the cells of the sole while others simply retard the intake or exhaust of air as weight is shifted about the sole.

Clearly, none of these prior art designs specifically induce nor even seek to induce activity of the muscle groups of the leg and foot responsible for compensation of the angular orientation of the foot.

SUMMARY OF THE INVENTION

The present invention provides a shoe sole or insole that causes the majority of the wearer's foot and leg muscles to be activated even while traversing a flat, level, unchanging and unyielding surface or when simply shifting one's weight from foot to foot while stationary. This result is obtained by the incorporation of an inflatable or expandable cell structure within the sole that causes a weighted foot's angular orientation relative to the support surface to vary as a function of the degree or distribution of inflation or expansion. A means is provided to continuously vary the degree or distribution of inflation, and most importantly, such variation follows a random or pseudo-random sequence. A pseudo-random sequence is defined as a repeated sequence sufficiently long or complex to substantially preclude the wearer from subconsciously anticipating successive angular orientations of the foot.

In its simplest form, the present invention calls for the placement of a single inflatable cell within a relatively flexible and resilient shoe sole in a position such that a foot supporting weight thereon is canted upwardly about 3° to 5° relative to the support surface when the cell is fully inflated, and alternatively, is canted downwardly about 3° to 5° relative to the support surface when the cell is completely deflated. The "memory" of the sole material surrounding the cell causes the cell to inflate when unweighted by drawing air in through a check valved duct, while a variable position valve regulates the escape of air through another duct as weight is applied to the cell. Whether or not air can escape is dependent upon the position of a rotatable cam within the valve which is incrementally rotated by the reciprocation of the plunger of a ratchet mechanism. The highest spots on the cam squeeze the exhaust duct completely closed, the lowest spots along the cam allow the unimpeded exhaust of air while the intermediate heights along the cam profile throttle the flow of escaping air. The plunger is spring-loaded and positioned within the sole such that it is depressed and released with each step. The cam profile is sufficiently complex such that a pseudo-random sequence of valve positions, and hence cell deflation, results with the incremental rotation of the cam.

In more complex embodiments of the invention, additional cells are distributed throughout the sole such that longitudinal and lateral variations in the angular orientation of the foot are achieved. A valving structure regulates the inflation and deflation of each cell or groups of cells to provide the desired pseudo-random sequence of inflation patterns, and hence foot orientations.

Alternatively, the present invention contemplates closed system embodiments in which any of various fluids, such as gas, water, oil, gels or coolants are shifted amongst a plurality of cells in a random or pseudo-random sequence. Such cells are distributed throughout the shoe sole or insole and expand or inflate upon introduction of such fluids thereinto and contract or deflate upon drainage of such fluids therefrom. The weighting of the sole during a step cycle provides the force for pumping while a valve controls the flows.

Other features and advantages of the present invention will become apparent from the following detailed description, taken in conjunction with the accompanying drawings, which illustrate by way of example, the principles of the invention.

DETAILED DESCRIPTION OF PREFERRED EMBODIMENTS

Figure 1:
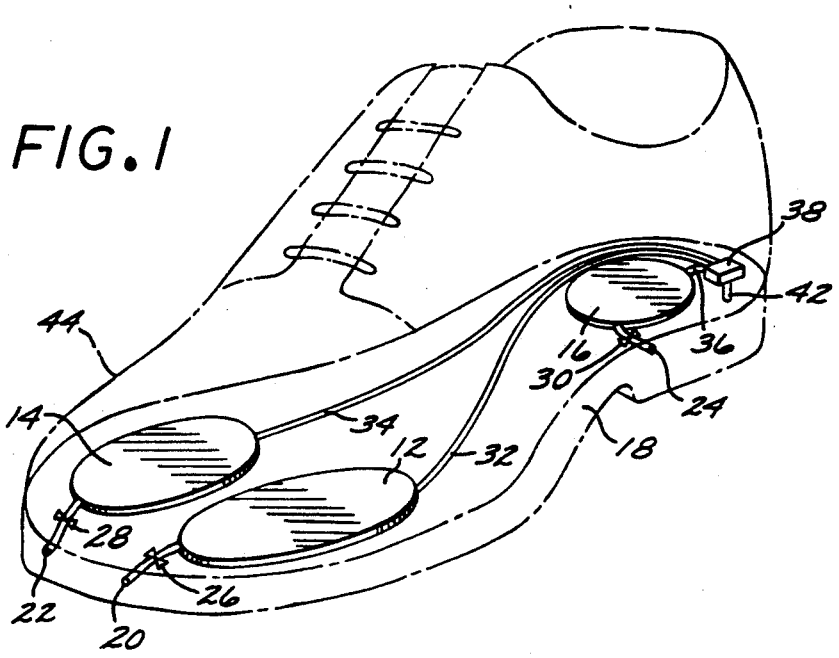
FIG. 1 is a perspective view of a shoe incorporating an embodiment of the present invention.

The invention generally provides a shoe sole or insole adaptable to a wide variety of shoe designs. As per the invention, FIG. 1 illustrates a preferred embodiment of such a sole, wherein a number of inflatable cells 12, 14, 16 are incorporated within a relatively flexible and resilient sole 18. The cells 12, 14, 16 are of sufficient size and in positions such that the angular orientation of a wearer's foot relative to a supporting surface is altered upon their inflation. Each cell is in communication with the exterior through its intake duct 20, 22 and 24, which allows air to enter the respective cell through a one-way check valve 26, 28, 30. Air from within the cells is exhausted through exhaust ducts 32, 34, 36, which communicate with the exterior via variable position valve 38. Plunger 42 extends from valve 38 and serves to reset the position of variable position valve 38 when depressed as weight is applied and the surrounding sole 18 compresses.

Figure 2:
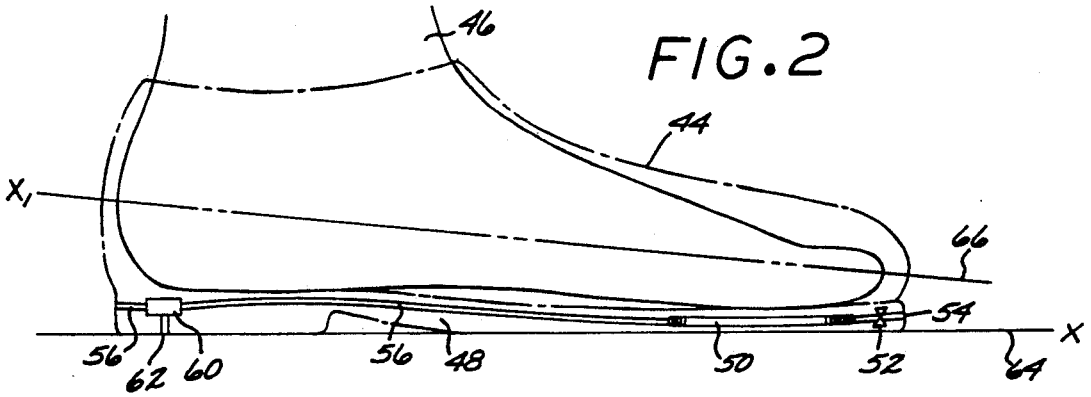
FIG. 2 is a cross-sectional view of a shoe incorporating an embodiment of the present invention with a cell in its deflated state.
Figure 3:
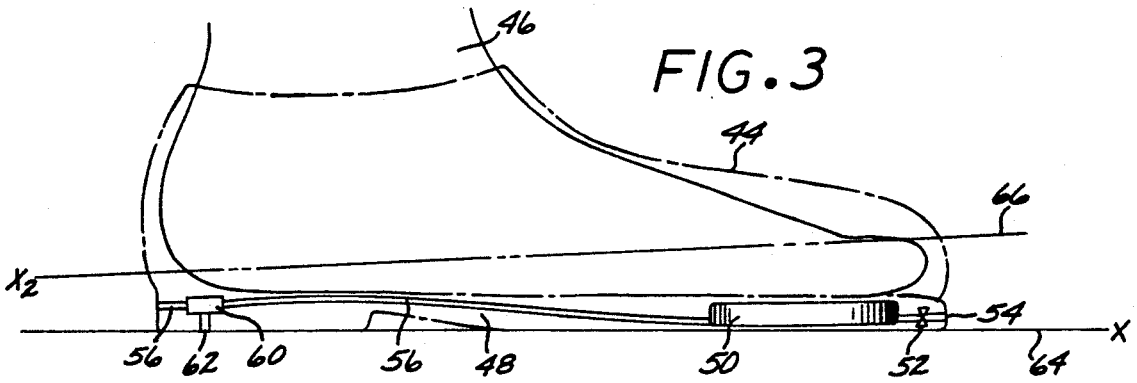
FIG. 3 is a cross-sectional view of the embodiment of FIG. 2 with the cell in its inflated state.

FIG. 2 illustrates an embodiment of the present invention wherein a single inflatable cell 50 is incorporated in shoe sole 48. The inflatable cell draws air in from the exterior through intake duct 5 having a one-way check valve 52 incorporated therein. An exhaust duct 56 routes air from the cell to the exterior via valve 60 and duct 56. Plunger 62 resets the position of valve 60 when depressed upon a weighting of the sole 48. FIG. 2 illustrates the cell 50 in its fully deflated state. A foot 46 supported thereby consequently angles downwardly relative to the supporting surface 64 as emphasized by the angle of the foot's longitudinal axis 66. FIG. 3 illustrates the arrangement shown in FIG. 2 when cell 50 is fully inflated, which causes the foot 46 to angle upwardly.

Figure 4:
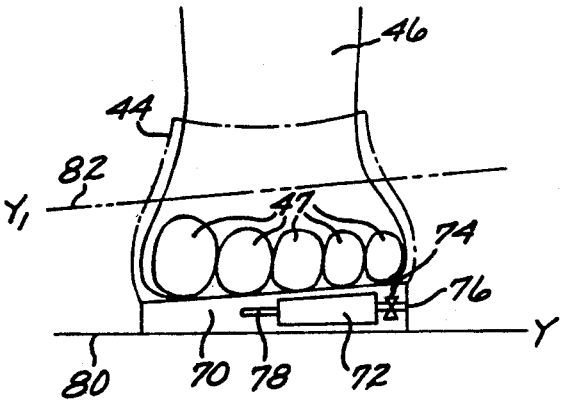
FIG. 4 is a cross-sectional view of a shoe incorporating an embodiment of the present invention with a cell in its inflated state.
Figure 5:
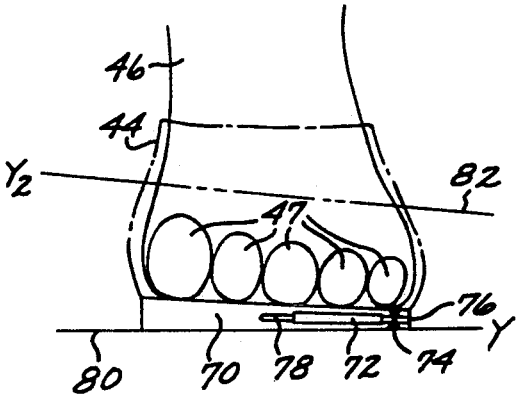
FIG. 5 is a cross-sectional view of the embodiment of FIG. 4 with the cell in its deflated state.

FIG. 4 illustrates another embodiment of the invention wherein a inflatable cell 72 is incorporated in sole 70. Intake duct 76 connects cell 72 with the exterior via one-way check valve 74. Exhaust duct 78 is in communication with the exterior through a variable position valve (not shown). Reference numeral 82 identifies a lateral axis of foot 46. The embodiment illustrated in FIG. 5 is identical to that of FIG. 4 with the exception that cell 7 is fully deflated.

Figure 6:
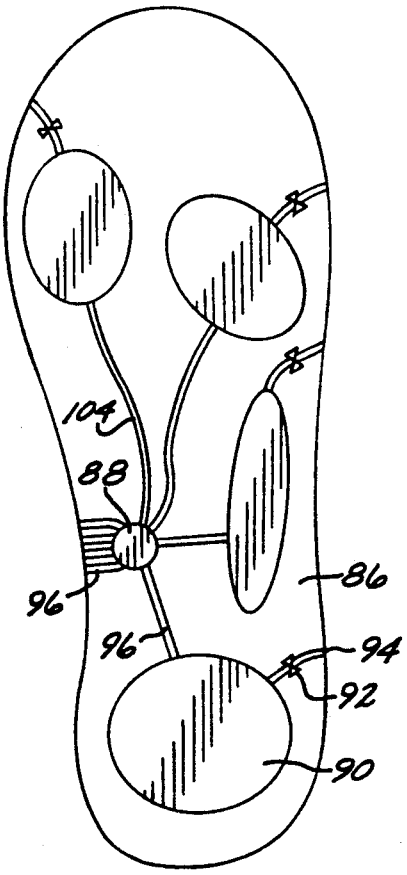
FIG. 6 is a cross-sectional view of a shoe sole according to the present invention.
Figure 7:
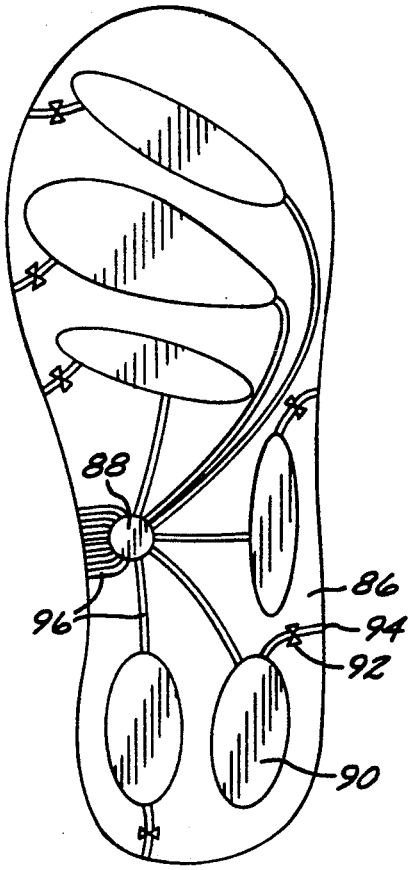
FIG. 7 is a cross-sectional view of another shoe sole of the present invention.

FIGS. 6 and 7 illustrate the layout of alternative embodiments of the invention. In FIG. 6, a total of 4 inflatable cells 90 are distributed throughout sole 86, while FIG. 7 shows 6 separate inflatable cells distributed throughout the same area. Each cell 90 is in communication with the exterior through an intake duct 94 incorporating a one-way check valve 92 therein. An exhaust duct 96 is in communication with the exterior through variable position valve 88 The distribution of cells is selected to maximize their effect on the angular orientation of the foot. A widely spaced distribution below load-bearing areas of bone structure achieves this effect.

Figure 8:
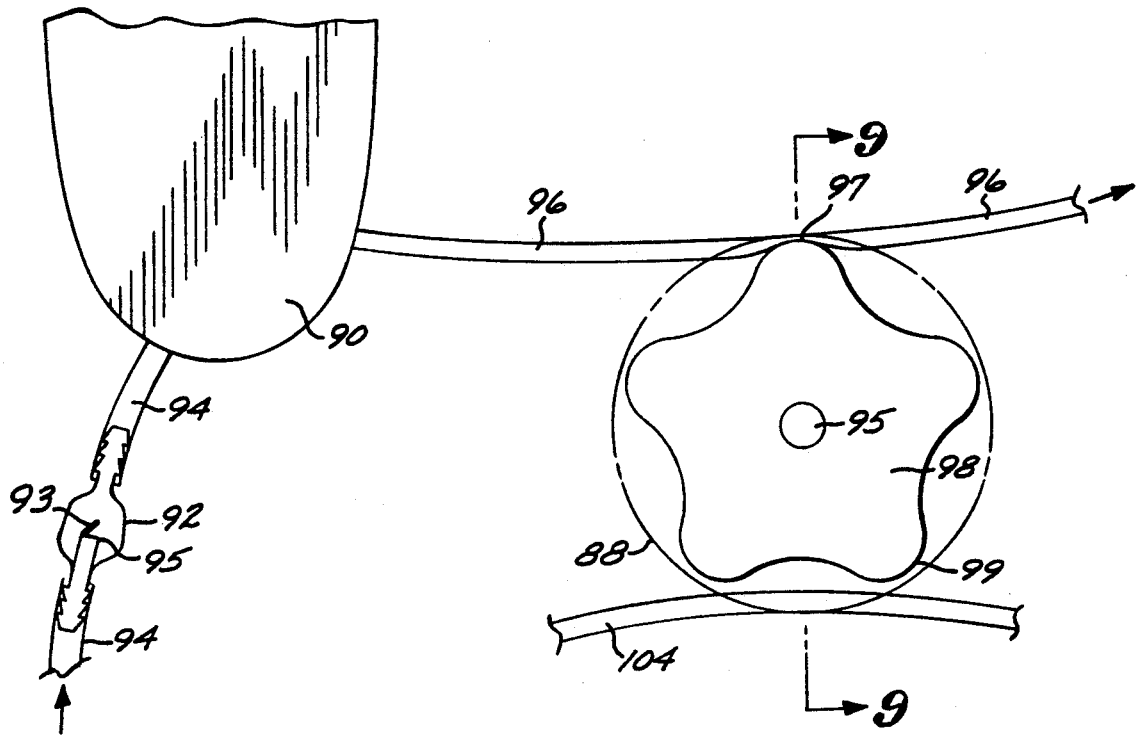
FIG. 8 is an enlarged cross-sectional view of components of a shoe sole according to the present invention.

FIG. 8 is a cross-sectional detail of an inflatable cell 90 with its associated ducting and valving. It is exemplary of all such inflatable cells found throughout the FIGS. 1–7. Each inflatable cell 90 is in communication with the exterior through intake duct 94. A one-way check valve 92 is positioned in line with the intake duct 94 and can utilize any of a number of mechanisms known throughout the art. Illustrated is a simple flap type check valve wherein a flap 93 is hingidly affixed to a valve seat 95. Such an arrangement allows the free flow of fluid in one direct yet automatically and positively checks the flow in the opposite direction. The valve 92 is oriented such that air can freely flow into cell 90 while preventing its exit therefrom. Inflatable cell 90 is additionally attached to exhaust duct 96. The exhaust duct 96 passes through variable position valve 88. The variable position valve can utilize any number of mechanisms known throughout the art in order to achieve the desired function. Illustrated, by way of example only, is a valve utilizing a rotatable cam 98, which rotates about 95. The cam 98 has an irregular profile 99, and serves to restrict the flow of fluid through duct 96 when rotated to a position such that a high point on the cam pinches duct 96 shut at 97 against the valves outer casing. Conversely uninhibited flow through duct 96 results when point 97 is adjacent a low spot on cam 98. An intermediate height of cam's profile 99 contacting duct 96 causes a reduced flow of air as cell 90 is weighted.

Figure 9:
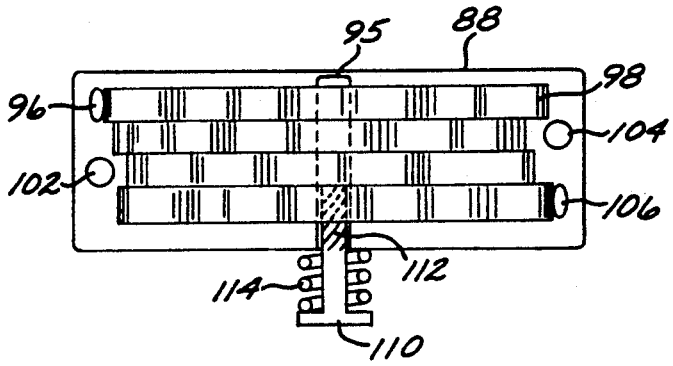
FIG. 9 is a further enlarged cross-sectional view of a valve taken along line 9—9 of FIG. 8.

FIG. 9 is a cross-sectional view of valve 88 illustrating how the flow of fluid through a total of four ducts is controlled as called for in the arrangement illustrated in FIG. 6. A total of four cams 98 are disposed therein in a concentric, stacked arrangement, each having its own cam profile 99. The particular combination of cams and cam profiles in the particular position illustrated cause exhaust ducts 96 and 106 to be collapsed and hence restrict flow of fluid therethrough, while ducts 102 and 104 are fully open allowing for an unrestricted flow of fluid. The plunger's threaded surface 112 is received by complementary threading within the interior of cams 98. Means are provided to prevent the rotation of plunger 110, which causes the cams to rotate upon depression of plunger 110. A spring 114 insures the extraction of plunger 110 from within the cams upon release, while a ratchet means (not shown) prevents the rotation of the cams to their previous position. Plunger activated ratcheting mechanisms are well known in for example the art of retracting ballpoint pen construction and are similarly well known in the art of electrical switch design (see for example U.S. Pat. No. 3,694,603). The amount of rotation obtained by this mechanism must be selected so as to take full advantage of the irregular cam profile. Thrust bearing 95 holds the stack of cams in position and allows their free rotation.

The flexibility and resilience of the shoe sole material is critical to the proper function of the shoe sole of the above-described embodiments. The shoe sole must be sufficiently flexible to allow the sole to collapse when an inflatable cell contained therein is in a deflated state and weight is applied. On the other hand, the material must be sufficiently resilient and have a "memory" to cause the sole material to return to its original shape after a deflated cell is unweighted and thereby draw air back into the cell.

In operation, all cells automatically inflate when the shoe sole is unweighted. The memory of the shoe sole material surrounding cell 90 serves to draw the cell apart and inflate or "inhale" through the intake duct 94. The one-way check valve 92 does not inhibit the flow of air into the cell. Upon the application of weight, force is applied to each cell 90. The one-way check valve 92 prevents the escape of air through intake duct 94. Whether or not air can escape through exhaust duct 96 is determined by the position of the rotatable cam 98 within valve 88. When a low spot on the cam surface 99 is adjacent location 97 within valve 88, duct 96 is at full diameter allowing all the air within cell 90 to escape as the foot applies weight thereto. The cell deflates and collapses and causes that part of the foot directly thereover to assume a lower position (FIG. 2 and 5) If on the other hand a high spot on cam surface 99 is adjacent to location 97, the exhaust duct is squeezed shut to prevent air from escaping from that cell. Consequently, the cell remains inflated which causes that part of the foot directly thereover to remain at a higher position relative to the supporting surface (64, 80). With each step, plunger 110, fully surrounded by relatively compressible sole material, is depressed to impart an incremental rotation to cam 98. The sequence of inflation and deflation is determined by the contour of the cam profile 99 which is sufficiently complex to achieve a pseudo-random sequence as set forth above. While the incorporation of a single cell within a shoe sole can achieve the purposes of the invention, a plurality of cells enables a more complex variation in support pattern to be achieved. The selected profiles of the cams, as well as their particular orientations relative to one another, orchestrate the change of patterns from step to step.

Figure 10:
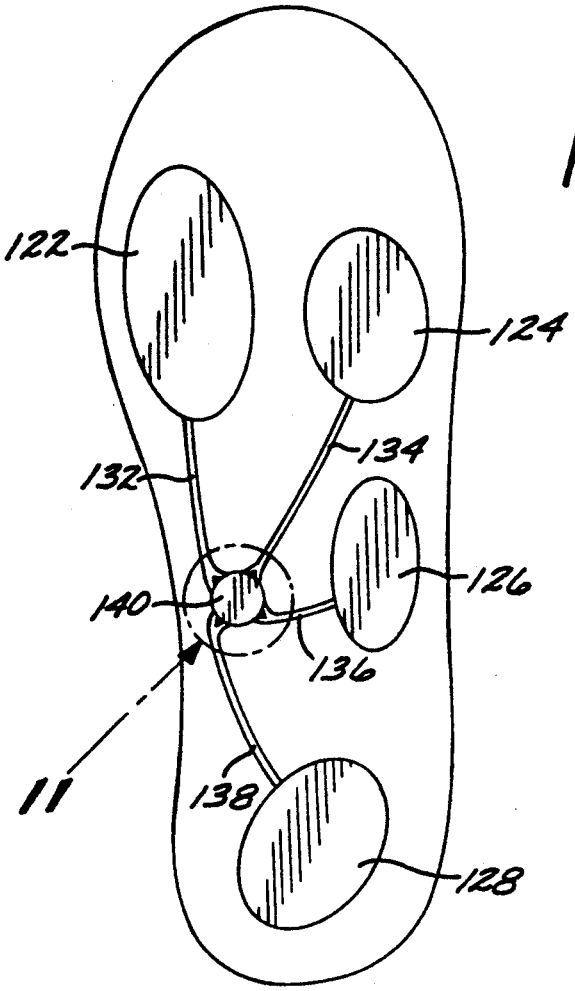
FIG. 10 is a cross-sectional view of yet another shoe sole according to the present invention.
Figure 11:
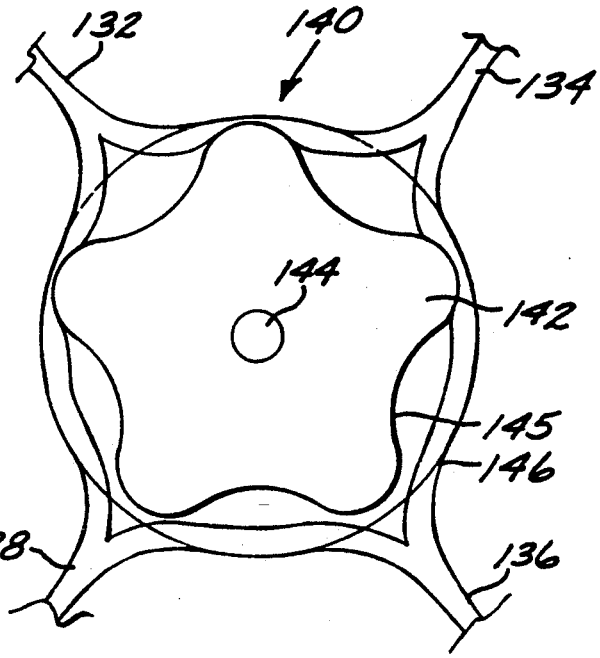
FIG. 11 is an enlarged view of the circled area of FIG. 10.

FIGS. 10 and 11 illustrate an alternative embodiment of the present invention wherein a closed system is employed to achieve variation in the shoe sole's support pattern with successive steps. The system serves to redistribute a constant amount of fluid, either in the form of a gas, liquid, or cell, amongst a plurality of cells. The amount of fluid contained in a particular cell will determine the elevation of that part of the foot directly thereover and hence, will effect the attitude of the entire foot.

FIG. 10 illustrates four cells 122, 124, 126, 128 distributed throughout sole 120. Ducts 132, 134, 136, 138 serve to interconnect the various cells subject to the position of valve 140. In a fashion similar to the illustrations of FIGS. 8 and 9, cam 142 is incrementally rotated about a central axis 144 via a plunger/ratchet mechanism (not shown) which is activated with every step. The irregular cam profile 145 causes various combinations of interconnecting ducts within valve casing 146 to be contacted to either wholly or partially close them off. This has the effect of intermittently either isolating a particular cell or interconnecting two or more cells.

A quantity of fluid less than what is necessary to fill the entire system is contained within the system. The application of weight to the various cell causes the fluid contained therein to be redistributed subject to the position of the valve. The position of the valve is altered with every step and as a result a shoe sole with a varying support pattern is provided, the complexity of the cam profile and the dynamics of the filling and emptying cells contributing to provide a pseudo-random, possibly truly random sequence.

By way of example, FIG. 11 illustrates a valve position which completely isolates cell 124, fully interconnects cell 126 and 128 and allows a reduced flow of fluid between cell 122 and cells 126 and 128. Depending upon the degree to which particular cells are filled will determine the direction of flow during the step. Additionally, the fact that pressure is applied progressively from the heel towards the ball and toes effects the dynamics of the fluid.

While a particular form of the invention has been illustrated, it will also be apparent to those skilled in the art that various modifications can be made without departing from the spirit and scope of the invention. For instance, many alternative designs are readily available to those skilled in the art to achieve a one-way check valve function or for a valve to achieve a random or pseudo-random sequence of openings and closings of conduits. Alternatively, a valve and pump arrangement is conceivable where the individual cells are actively rather than passively inflated. Accordingly, it is not intended that the invention be limited except as by the appended claims.

What is claimed is:

1. A sole for providing support to a foot within a shoe, comprising:

an inflatable cell disposed within such sole wherein the angular orientation of a foot supported by such sole relative to a supporting surface under said sole is a function of said cell's degree of inflation; and means for inflating and deflating said cell such that said cell's state of inflation follows a sequence sufficiently complex to achieve a complex variation in the successive angular orientations of the foot, whereby the wearer may be substantially precluded from anticipating the sequence.

2. The sole of claim 1 wherein said sole is constructed of resilient material selected such that said cell formed therein automatically assumes an expanded shape when said sole is unweighted and further comprises:

a check valve in communication with said cell configured to allow air to be drawn into said cell when said cell automatically expands upon unweighting of said sole, and prevent escape of air from said cell therethrough when said sole is weighted; and a valve for variably limiting the amount of air escaping from said cell upon weighting of said sole, the amount escaping being varied with each successive weighting and unweighting cycle of said sole, the sequence of variation being pseudo-random.

3. The sole of claim 2 wherein said valve for variably limiting the amount of air escaping from said cell comprises:

a duct through which air from within said cell can escape;

a rotatable cam having an irregular surface, a portion of which surface is brought to bear on said duct, the radius of that portion of said surface bearing upon said duct being determinative of the amount of air permitted to escape; and a ratchet mechanism wherein depression of a plunger incrementally rotates said cam, said plunger being depressed with each weighting of said sole.

4. A sole for providing support to a foot within a shoe, comprising:

a plurality of inflatable cells disposed within such sole wherein the angular orientation of a foot supported by such sole in relation to a supporting surface under said sole is a function of the pattern defined by combinations of inflate and deflated cells at any time; and means for sequentially inflating and deflating each of said cells in a sequence which defines said pattern as the sole is alternatively weighted and unweighted by said foot.

5. The sole of claim 4 further comprising:

means for drawing air into each cell when said sole is unweighted; and means for controlling the escape of air from each cell upon the application of weight to said cells.

6. The sole of claim 5 wherein said means for controlling the escape of air comprises a multi position valve which is repositionable with each step.

7. The sole of claim 4 wherein said cells are interconnected and a preselected quantity of fluid, said preselected quantity being less than the quantity necessary to entirely fill all cells, is contained within said cells.

8. The sole of claim 7 wherein said inflating and deflating means comprises a multi position valve which controls the flow of fluid amongst the interconnected cells.

9. The sole of claim 7 wherein said valve is repositionable with every step.

10. The sole of claim 6 wherein said valve's positions include fully-opened, fully-closed and partially closed positions.

* * * * *

UNITED STATES PATENT AND TRADEMARK OFFICE

CERTIFICATE OF CORRECTION

PATENT NO. : 5,179,792

DATED : January 19, 1993

INVENTOR(S) : Charles R. Brantingham

It is certified that error appears in the above-identified patent and that said Letters Patent is hereby corrected as shown below:

Col. 6, line 21 after or, delete "cell" insert --gel--.

Signed and Sealed this

Sixteenth Day of November, 1993

Bruce Lehman

*Attest:*

BRUCE LEHMAN

*Attesting Officer*

*Commissioner of Patents and Trademarks*